US006952626B1

(12) United States Patent
Taguchi et al.

(10) Patent No.: US 6,952,626 B1
(45) Date of Patent: Oct. 4, 2005

(54) EMBROIDERY DATA PRODUCING DEVICE AND EMBROIDERY DATA PRODUCING CONTROL PROGRAM STORED ON COMPUTER-READABLE MEDIUM

(75) Inventors: Shoichi Taguchi, Nagoya (JP); Mikitoshi Suzuki, Nagoya (JP); Masahiro Mizuno, Nagoya (JP); Yukiyoshi Muto, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/090,988

(22) Filed: Mar. 28, 2005

(30) Foreign Application Priority Data

Mar. 30, 2004 (JP) ..... 2004-099085

(51) Int. Cl.[7] ..... G06F 19/00; D05C 5/02
(52) U.S. Cl. ..... 700/138; 112/102.5
(58) Field of Search ..... 700/138, 136, 700/137; 112/102.5, 470.06; 382/11

(56) References Cited

U.S. PATENT DOCUMENTS 5,560,306 A * 10/1996 Kyuno et al. ..... 112/102.5
5,576,968 A * 11/1996 Mizuno et al. ..... 700/138
5,839,380 A * 11/1998 Muto ..... 112/102.55
6,256,551 B1 7/2001 Muto
6,324,441 B1 11/2001 Yamada

FOREIGN PATENT DOCUMENTS

| | | |
|---|---|---|
| JP | 11-57260 | 3/1999 |
| JP | 2000-288275 | 10/2000 |
| JP | 2003-53069 | 2/2003 |
| JP | 2003-53072 | 2/2003 |
| JP | 2003-53074 | 2/2003 |

* cited by examiner

*Primary Examiner*—Peter Nerbun
(74) *Attorney, Agent, or Firm*—Oliff & Berridge, PLC

(57) ABSTRACT

An embroidery data producing device for use with an embroidery sewing machine sewing an embroidery pattern on work cloth using a needle thread and a bobbin thread is disclosed. The embroidery data producing device produces sewing data necessary for an embroidery sewing operation of the embroidery sewing machine. The embroidery data producing device includes an image data obtaining unit that obtains image data of an original image of an embroidery pattern, a dot pattern data producing unit that produces dot pattern data representative of the embroidery pattern by a dot pattern, based on the image data, and a sewing data producing unit that produces sewing data for obtaining needle drop points forming the embroidery pattern by a pattern of the needle thread appearing in the form of dot on a back of the work cloth by an embroidery sewing operation of the embroidery sewing machine, based on the dot pattern data.

17 Claims, 10 Drawing Sheets

(Cyan)

(Magenta)

(Yellow)

(Black)

| DOT DENSITY | DRIVE VOLTAGE OF NEEDLE THREAD TENSION SOLENOID |
|---|---|
| 0~1 | $V_0$ |
| 2~3 | $V_1$ |
| 4~6 | $V_2$ |
| 7~10 | $V_3$ |

WHERE $V_3 < V_2 < V_1 < V_0$

FIG.11

EMBROIDERY DATA PRODUCING DEVICE AND EMBROIDERY DATA PRODUCING CONTROL PROGRAM STORED ON COMPUTER-READABLE MEDIUM

CROSS-REFERENCE TO RELATED APPLICATION

This application claims priority from JP 2004-99085 filed Mar. 30, 2004, the entire disclosure of which is incorporated herein by reference thereto.

BACKGROUND OF THE INVENTION

1. Field

This disclosure relates to an embroidery data producing device and an embroidery data producing control program producing sewing data necessary for an embroidering operation of a embroidery sewing machine, and more particularly to such an embroidery data producing device and an embroidery data producing control program in which an embroidery pattern can be expressed pictorially by a needle thread pattern appearing in the form of dots on a back of work cloth.

2. Description of the Related Art

Various types of embroidery data producing devices have conventionally been proposed and put to practical use for embroidery sewing machines sewing embroidery pattern on a top surface of work cloth using a needle thread (upper thread) and a bobbin thread (lower thread). The embroidery data producing devices produces sewing data necessary for an embroidering operation. For example, Japanese Patent Application Laid-Open JP-A-11-57260 corresponding to U.S. Pat. No. 6,256,551B1 discloses one of such conventional embroidery data producing devices. The disclosed embroidery data producing devices comprises a control device to which a CRT display, flexible disc device, image scanner and the like are connected. An original image of embroidery pattern is read by the image scanner so that image data is produced. Outline data is produced on the basis of the image data. Embroidery data is produced so that a region encircled by an outline is filled with embroidery stitches on the basis thereof.

Japanese Patent Application Laid-Open JP-A-2000-288275 corresponding to U.S. Pat. No. 6,324,441B1 also discloses an embroidery data producing device. For example, a photograph as an original image is read by an image scanner so that image data is obtained. The image data is divided into small mosaic blocks. A thread color is determined for every block in producing embroidery data.

The aforementioned conventional devices can use a photograph as an original image. However, an embroidery pattern is formed by filling a region between outlines or a square block with satin stitches. Accordingly, the sewn embroidery pattern is poor in pictorial expression and cannot be sufficiently expressive of such a feeling as produced by a photographic image. Furthermore, a stitch forming sequence is restricted severely.

SUMMARY

Therefore, an object of the disclosure is to provide an embroidery data producing device and an embroidery data producing control program which can produce embroidery data on which an embroidery pattern can be sewn by stitches which are rich in pictorial expression and sufficiently expressive of such a feeling as produced by a photographic image.

In sewing an embroidery pattern on work cloth by an embroidery sewing machine, the inventors opposed to a conventional common knowledge that embroidery stitches were formed on a top surface of the work cloth by a needle thread. On the contrary, the inventors paid their attention to a needle thread appearing in the form of dots at needle drop points on the back of work cloth when embroidery had been sewn. The inventors conceived that an embroidery pattern was able to be expressed on the back of the work cloth by utilizing the needle thread appearing in the form of dots, and made the present invention.

The disclosure provides an embroidery data producing device for use with an embroidery sewing machine sewing an embroidery pattern on work cloth using a needle thread and a bobbin thread. The embroidery data producing device produces sewing data necessary for an embroidery sewing operation of the embroidery sewing machine. The embroidery data producing device comprises an image data obtaining unit that obtains image data of an original image of an embroidery pattern, a dot pattern data producing unit that produces dot pattern data representative of the embroidery pattern by a dot pattern, based on the image data, and a sewing data producing unit that produces sewing data for obtaining needle drop points forming the embroidery pattern by a pattern of the needle thread appearing in a form of dot on a back of the work cloth by an embroidery sewing operation of the embroidery sewing machine, based on the dot pattern data.

Sewing data is produced which is used to obtain needle drop points forming the embroidery pattern by a pattern of the needle thread appearing in a form of dot on a back of the work cloth by an embroidery sewing operation of the embroidery sewing machine. The embroidery sewing machine is controlled so that an embroidery sewing operation is executed on the basis of the produced sewing data, whereupon an embroidery pattern is formed by dot-like stitches of the needle thread appearing on the back of the work cloth. In this case, the embroidery pattern can be sewn by stitches which are rich in pictorial expression and sufficiently expressive of such a feeling as produced by a photographic image even when a photograph is an original image.

A bobbin thread also appears on the back of the work cloth when an embroidery pattern is sewn. However, a thread to be used as the bobbin thread is generally thinner than a needle thread. Further, when a bobbin thread employed has, for example, a white color or the same color as work cloth, the bobbin thread is almost inconspicuous. Thus, it is confirmed that an adverse effect that an embroidery pattern of the needle thread is hidden by the bobbin thread can sufficiently be prevented.

BRIEF DESCRIPTION OF THE DRAWINGS

Other objects, features and advantages of the disclosure will become clear upon reviewing the following description of the embodiment with reference to the accompanying drawings, in which:

FIG. 11 shows set contents of a thread tension information table; and

DETAILED DESCRIPTION OF THE DISCLOSURE

Figure 1:
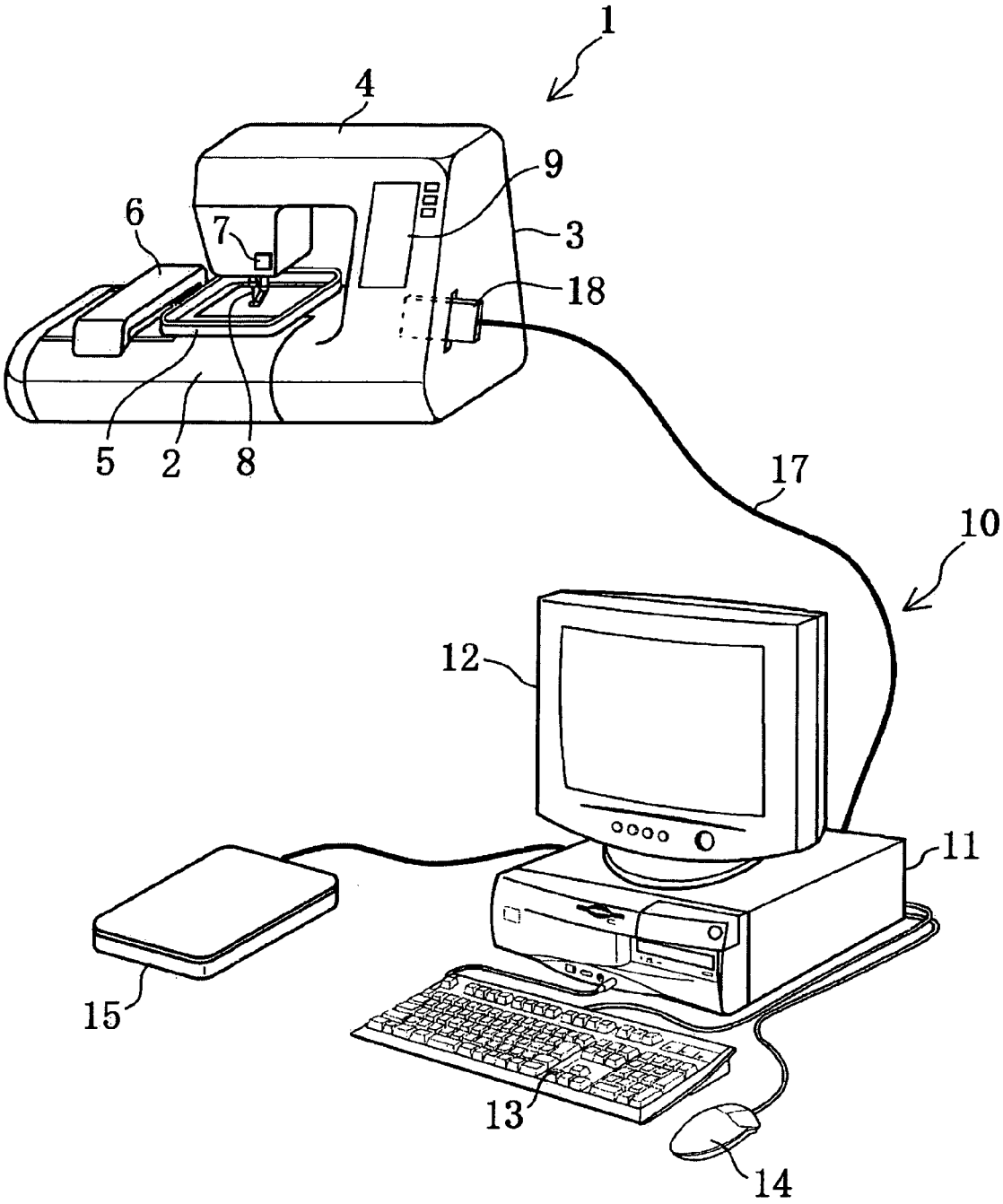
FIG. 1 is a perspective view of an embroidery sewing machine and a sewing data producing device of one embodiment in accordance with the disclosure.

One embodiment of the disclosure will be described with reference to the drawings. Referring to FIG. 1, an embroidery sewing machine 1 and a sewing data producing device 10 connected to the embroidery sewing machine 1 are shown. The embroidery sewing machine 1 will first be described. The embroidery sewing machine 1 is a household electronically controlled sewing machine and comprises a sewing bed 2, a pillar 3 and a sewing arm 4.

A loop taker (not shown) is provided in the bed 2. A cloth holding frame 5 holding work cloth W (see FIGS. 5 and 12) is provided on an upper surface of the bed 2. A frame driving mechanism 6 for moving the cloth holding frame 5 freely is also provided on the upper surface of the bed 2. The frame driving mechanism 6 comprises an X-direction drive motor and a Y-direction drive motor neither of which is shown and moves the cloth holding frame 5 and accordingly the work cloth W in the X (right-and-left) direction and Y (back-and-forth) direction freely.

A start switch 7 instructing start of sewing is provided on a front of the arm 4. Inside the arm 4 are provided a main shaft driven by a sewing machine motor and a needle-bar driving mechanism driving a needle bar with a sewing needle up and down by the rotation of the main shaft. Further, the loop taker is driven in synchronization with the needle bar by the rotation of the motor.

Figure 2:
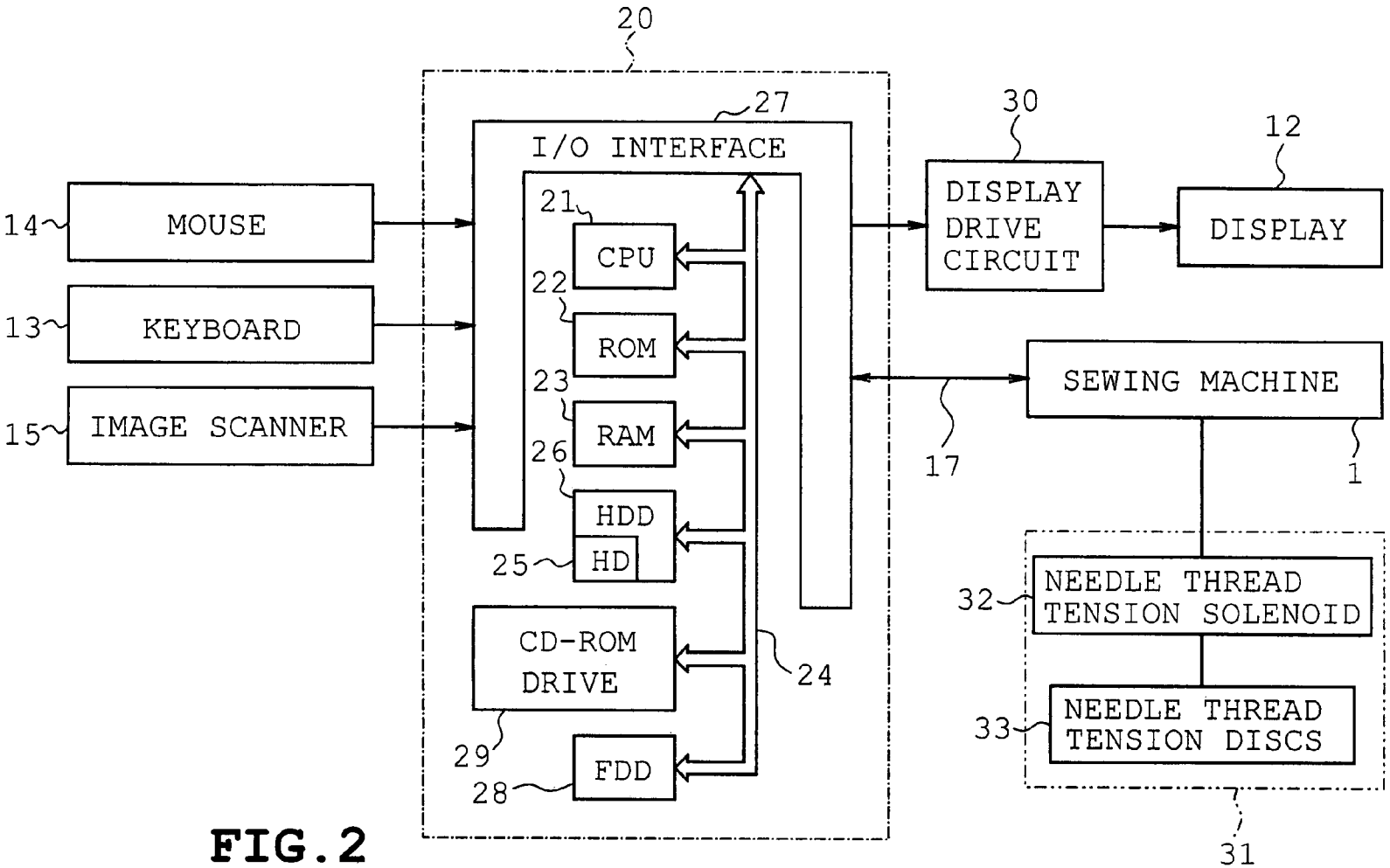
FIG. 2 is a block diagram of the control system of the sewing data producing device.

A needle thread tensioner 31 is provided in the arm 4 for adjusting tension of a needle thread NT (see FIG. 5), as shown only in FIG. 2. The needle thread tensioner 31 includes a pair of needle thread tension discs 33 pressing the needle thread NT therebetween. The needle thread tensioner 31 further includes a needle thread tension solenoid 32 for adjusting a pressing force of the pressing needle thread tension disc 33 against the pressed needle thread tension disc 33. Drive voltage to be applied to the needle thread tension solenoid 32 is changed so that the needle thread tension can automatically be adjusted by the needle thread tensioner 31.

A liquid crystal color display 9 is provided in the pillar 3. Further, a connecting code 17 connected to the sewing data producing device 10 which will be described later has a connector 18 which can be connected to the pillar 3, so that sewing data necessary for an embroidery sewing operation is transmitted from the sewing data producing device 10 to the embroidery sewing machine 1.

The embroidery sewing machine 1 includes a control device (not shown) driving the needle bar (and the loop taker) and further driving the frame driving mechanism 6 so that cloth holding frame 5 (work cloth W) in the X and Y directions, based on the sewing data. As a result, an embroidery sewing operation is carried out so that an embroidery pattern is sewn on the work cloth W by the use of the needle thread NT and a bobbin thread BT (see FIG. 5). Accordingly, the aforesaid sewing data contains data (stitch data) indicative of an amount of relative movement of the cloth holding frame 5 in the X and Y directions for every one time of sewing motion of the needle (needle drop point).

Furthermore, in the embodiment, thread tension information (data of drive voltage of the needle thread tension solenoid 32) is annexed to the sewing data as will be described later. The control device of the embroidery sewing machine 1 controls the needle thread tension solenoid 32 on the basis of the thread tension information, thereby automatically adjusting thread tension of the needle thread NT in the embroidery sewing operation. In this case, when the thread tension of the needle thread NT is relatively larger, stitches of the needle thread NT appearing (remaining) on the back Wr of the work cloth W to be sewn become small. On the contrary, when the thread tension is relatively smaller, stitches of the needle thread NT appearing on the back Wr of the work cloth W to be sewn become large.

The sewing data producing device 10 will now be described. The sewing data producing device 10 comprises a personal computer 11, to which a display 12, a keyboard 13, a mouse 14, an image scanner 15 capable of reading color image are connected, as shown in FIG. 1. The personal computer 11 comprises a microcomputer (not shown) and a control device 20 governing entire control concerning production of sewing data, as shown in FIG. 2. The control device 20 comprises a central processing unit (CPU) 21, a read only memory (ROM) 22, a random access memory (RAM) 23, a hard disc drive (HDD) 26 provided with a hard disc (HD) 25, an input-output (I/O) interface 27 and a bus 24 connecting the former devices to one another.

A flexible disc drive (FDD) 28 and CD-ROM drive 29 are also connected to the bus 24. To the I/O interface 27 are connected the keyboard 13, the mouse 14, the image scanner 15, a display drive circuit 30 driving the display 12 and the connecting code 17.

ROM 22 stores a starting program on which the personal computer 11 starts upon power supply and other programs. The hard disc 25 is incorporated with an operating system (OS), various drivers which render the display 12, keyboard 13, mouse 14, image scanner 15 and the like usable, application programs and the like. The hard disc 25 stores various control programs such as a sewing data producing control program which will be described later. The hard disc 25 further stores various data including image data read and produced by the image scanner 15, sewing data (stitch data) produced on the basis of the image data.

The aforementioned sewing data producing control program is provided in order that the computer (sewing data producing device 1) may execute the sewing data producing control. The sewing data producing control program includes an image data obtaining routine which obtains image data of an original image G (see FIGS. 3A and 7) of embroidery pattern F, a dot pattern producing routine which produces dot pattern data representative of the embroidery pattern F by a dot pattern, based on the image data, and a sewing data producing routine which produces sewing data for obtaining needle drop points forming the embroidery pattern F by a pattern of the needle thread NT appearing in the form of dot on a back Wr of the work cloth W by an embroidery sewing operation of the embroidery sewing machine 1, based on the dot pattern data.

Consequently, as will be described in detail later, the control device 20 of the sewing data producing device 10 executes the sewing data producing control program to obtain the image data of the original image G of embroidery pattern F and to produce dot pattern data representative of the embroidery pattern F by a dot pattern, based on the image data. Based on the dot pattern data, the control device 20 further produces sewing data for obtaining needle drop points forming the embroidery pattern F by a pattern of the needle thread NT appearing in the form of dot on a back Wr of the work cloth W by an embroidery sewing operation of the embroidery sewing machine 1.

In this case, the sewing data is produced so that the needle drop point coincides with a position of each dot of the dot pattern produced regarding the original image G of the embroidery pattern F as will be described later. Further, when the sewing data is produced, data of a plurality of needle drop points corresponding to the each dot of the dot pattern are calculated. The needle drop points are sequentially connected in a predetermined sewing direction (the X-direction, for example), whereby the sewing data is produced.

A pseudo-gradation technique is used to produce the dot pattern data. Further, the dot pattern data reversed horizontally relative to image data is produced. When color image data is obtained, the color image is separated into a plurality of colors (four colors) so that data of dot patterns classified by colors for a plurality of the colors are produced, respectively. When the data of dot patterns classified by colors are produced, the sewing data is produced so that a sewing direction differs for every dot pattern data classified by color. Thread tension information (data of drive voltage applied to the needle thread tension solenoid 32) is produced about needle thread tension adjustable by the needle thread tensioner 31 according to a dot density of the dot pattern data. The produced thread tension information is annexed to the sewing data.

Figure 3A:
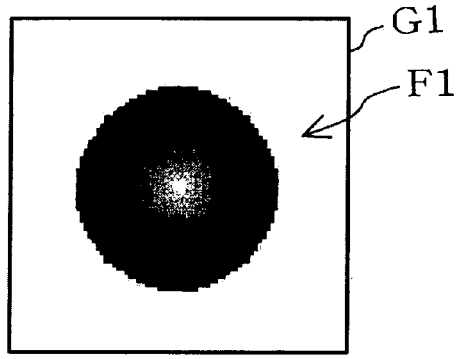
FIG. 3A illustrates an original image of circular pattern.
Figure 3B:
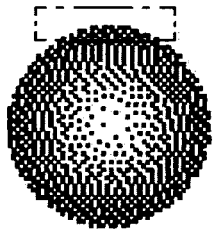
FIG. 3B illustrates a dot pattern to which a color subtraction process by the error diffusion technique is applied.

The operation of the sewing data producing device will now be described. Firstly, a sewing data producing process will briefly be described in which the sewing data is produced from image data of a circular pattern photographed as a monochromatic photo. An original image G1 (monochromatic photo) of a circular pattern F1 is read by the image scanner 15 as shown by FIG. 3A. As a result, image data comprising RGB values corresponding to the shape and color of the circular pattern F1 is obtained. Subsequently, the image data is reversed horizontally and then, dot pattern data (each pixel is either white or black) with a predetermined resolution (20 to 40 dpi, for example) is obtained from the reversed image data, as shown in FIG. 3B. For example, an error diffusion technique which is one type of pseudo-gradation technique expressing gradation is employed for production of the dot pattern. In the error diffusion technique, image conversion is carried out while a ratio of black pixels is dynamically changed according to brightness, and an error produced in a pixel is added to a subsequent pixel.

Figure 3C:
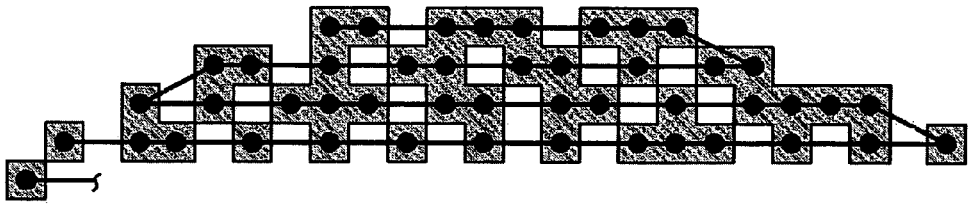
FIG. 3C is an enlarged view of needle drop points corresponding to respective dots.
Figure 3D:
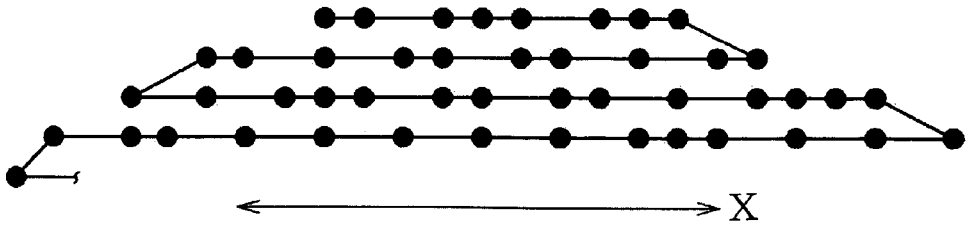
FIG. 3D explains sewing data (stitch data)

A number of needle drop points (shown by black circle) are obtained by calculation so as to correspond to locations of dots (black pixels) of the dot pattern data respectively, as shown in FIG. 3C which is an enlarged view of part of FIG. 3B. Lastly, as shown in FIG. 3D, sewing data (stitch data) is produced so that sewing is carried out in order of dot arrangement on the basis of the needle drop points while the sewing sequence is reciprocated in a predetermined sewing direction or the X-direction.

Figure 4:
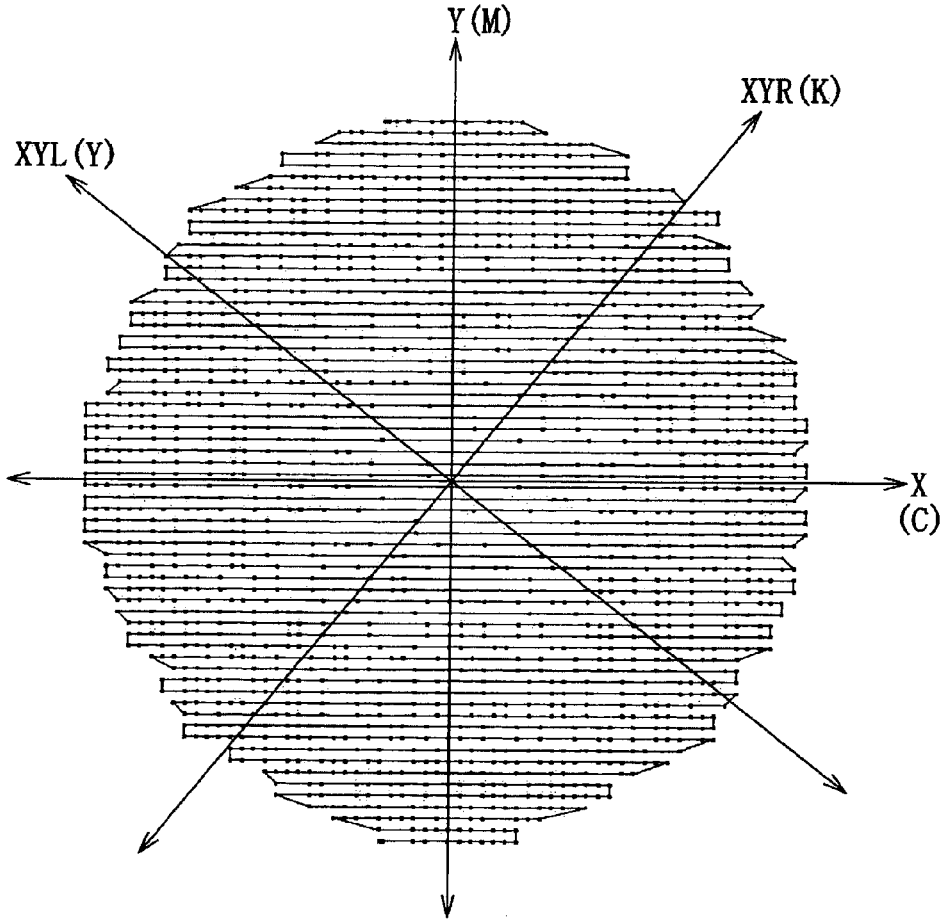
FIG. 4 illustrates an embroidery pattern appearing on the back of work cloth in the form of needle thread dot pattern.

The sewing data produced as described above is transmitted to the embroidery sewing machine 1. The sewing machine 1 executes the embroidery sewing operation based on the transmitted sewing data. Then, stitches of the needle thread NT appear in the form of dots at the needle drop points of the sewing needle 8 on the back Wr of the work cloth W, as shown in FIG. 4. Since the sewing data is produced the needle drop points correspond to the respective dots, the embroidery pattern F1 is formed by the dot-like needle thread stitches on the back Wr of the work cloth W so that a circular pattern is drawn. In this case, the circular embroidery pattern F1 can be expressed by stitches which are rich in pictorial expression and sufficiently expressive of such a feeling as produced by a photographic image.

Figure 5:
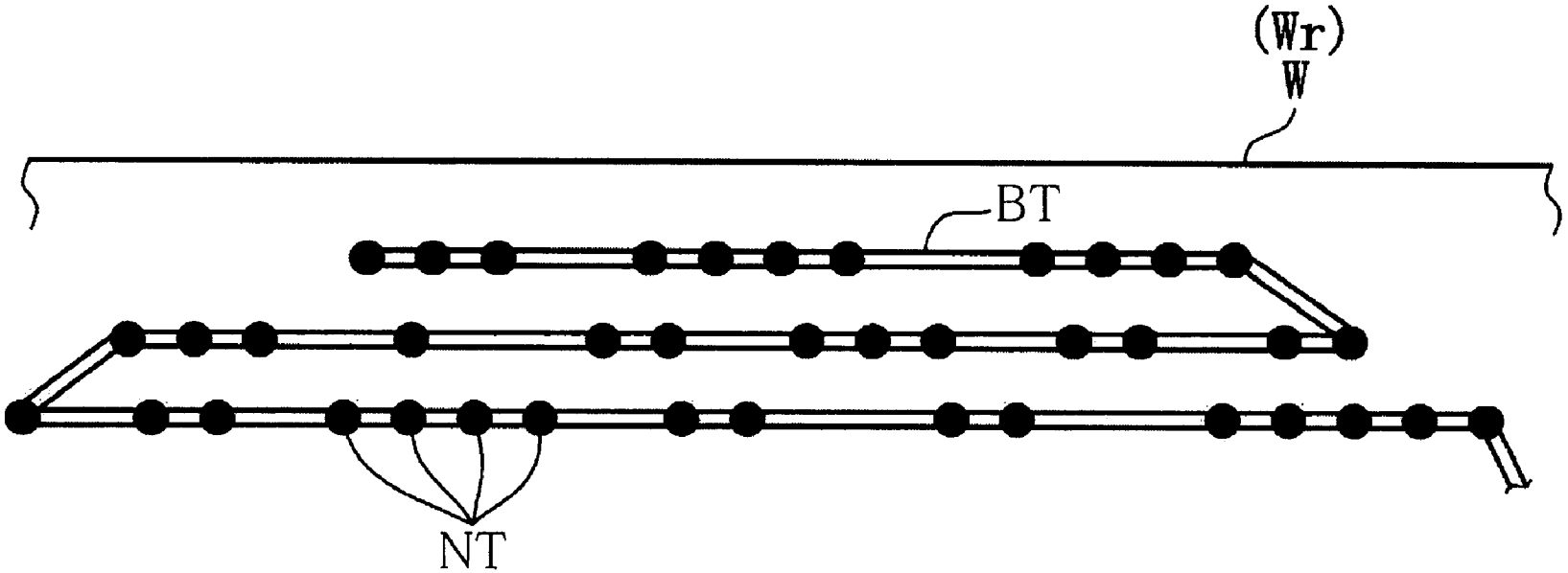
FIG. 5 is an enlarged view of needle thread dot pattern.

FIG. 5 shows an enlarged embroidery pattern formed on the back Wr of the work cloth W. The stitches of the needle thread NT are formed in the form of dots without being continuous at the locations corresponding to the respective dots of the dot pattern data. In this case, the bobbin thread BT also appears so as to extend across the needle drop points on the back Wr of the work cloth W when the embroidery pattern is sewn. However, the bobbin thread BT is generally thinner than the needle thread NT. Further, when the bobbin thread BT employed has, for example, a white color or the same color as the work cloth W, the bobbin thread BT is almost inconspicuous. Thus, it is confirmed that an adverse effect that an embroidery pattern of the needle thread NT is hidden by the bobbin thread BT can sufficiently be prevented.

Figure 6:
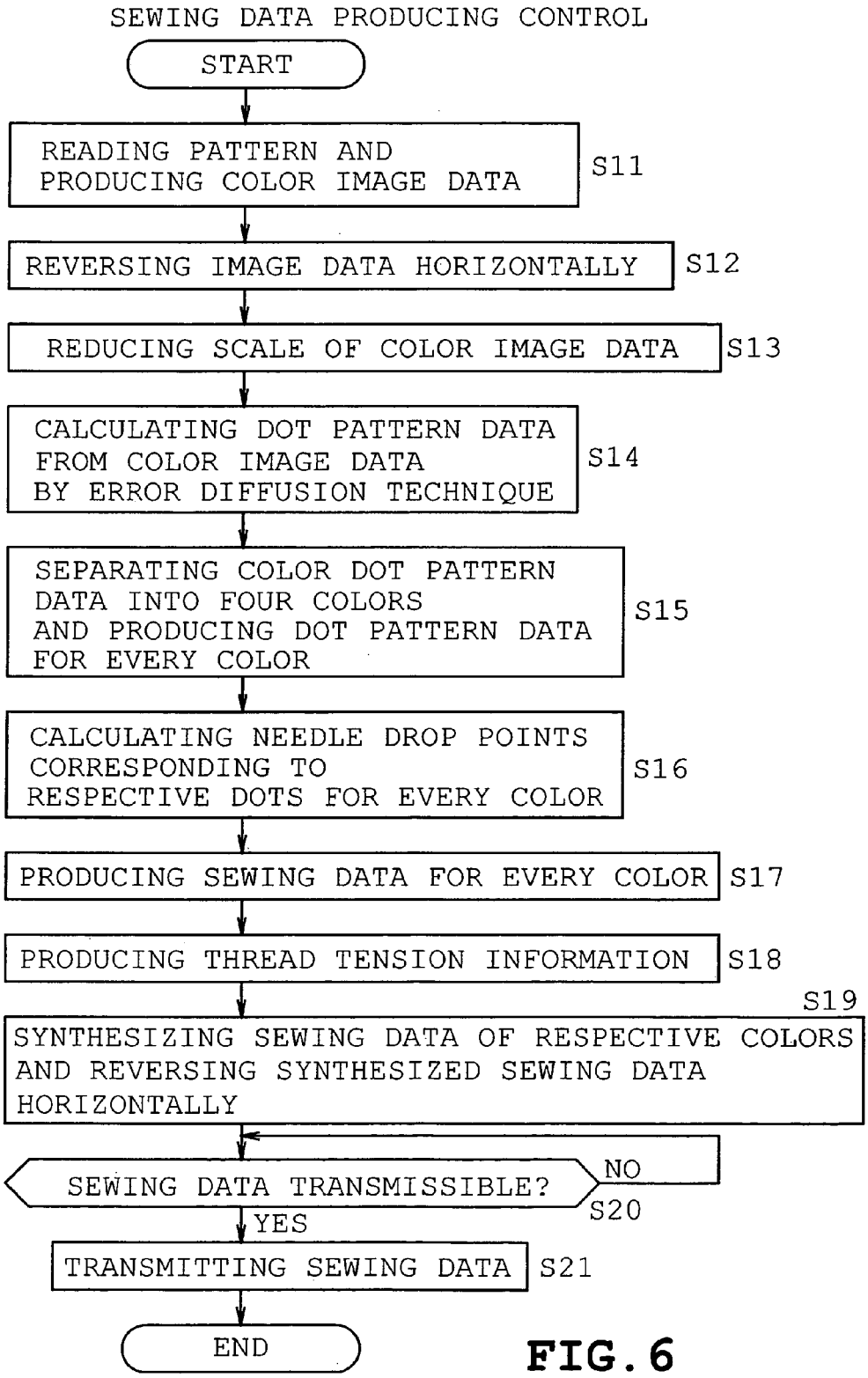
FIG. 6 is a flowchart showing a processing procedure in controlling sewing data production.

Next, the following describes the sewing data producing control program on which sewing data for four colors of yellow (Y), magenta (M), cyan (C) and black (K) is produced. FIG. 6 is a flowchart showing a processing procedure of the sewing data producing control to be executed by the sewing data producing device 10 (control device 20). In FIG. 6, symbol "Si" (where i=11, 12, 13 . . . ) designates a process step. An embroidery pattern F2 of "dog" as shown in FIG. 7 and so on is exemplified in the following description.

Figure 7:
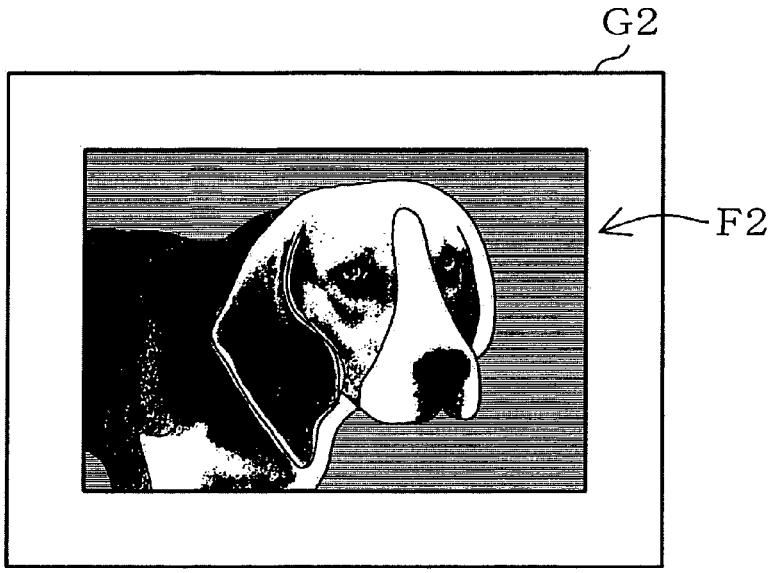
FIG. 7 illustrates an original image which is a color photograph of a dog.
Figure 8:
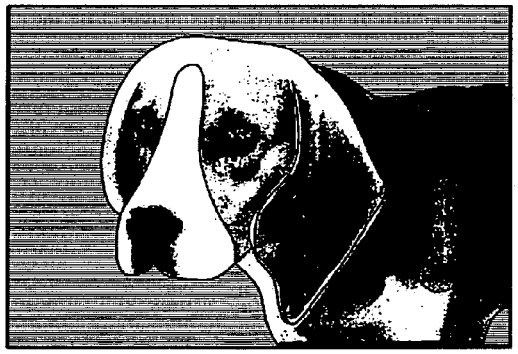
FIG. 8 shows data of color image reversed horizontally.

Previous to the start of the control, an original image G2 (color photo) which is a photo of a dog is set on the image scanner 15 as the embroidery pattern F2 shown in FIG. 7. The control starts when a predetermined key (a scan key, for example) on the keyboard 13 is operated. Firstly, an image on the original image G2 is read by the image scanner 15 and color image data of the embroidery pattern F2 is produced (S11). The color image data is composed of data comprising values of pixels of 256 gradations for each of red (R), green (G) and blue (B) regarding each pixel at a reading resolution (600 dpi, for example). The color image data is then reversed horizontally as shown in FIG. 8 (S12).

Figure 9:
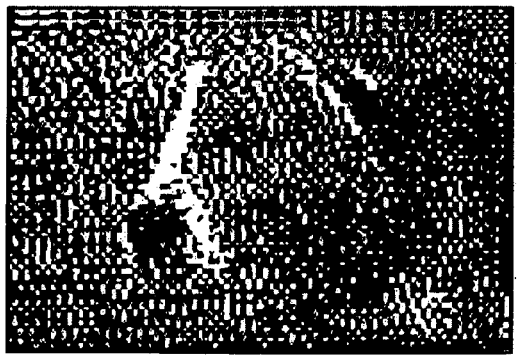
FIG. 9 shows data of subtracted color dot pattern.
Figure 10A:
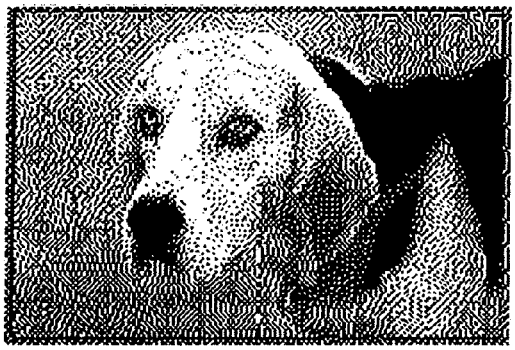
FIG. 10A shows dot pattern of separated cyan (C)
Figure 10B:
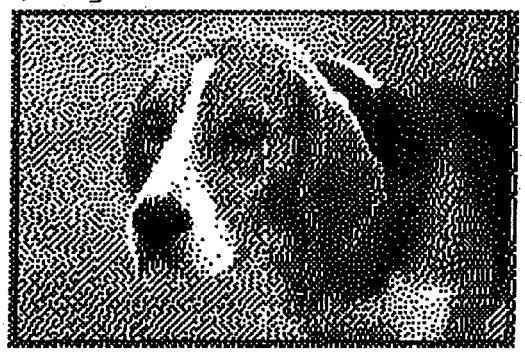
FIG. 10B shows dot pattern of separated magenta (M)
Figure 10C:
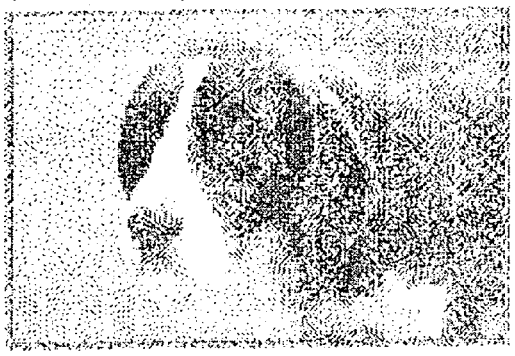
FIG. 10C shows dot pattern of separated yellow (Y)
Figure 10D:
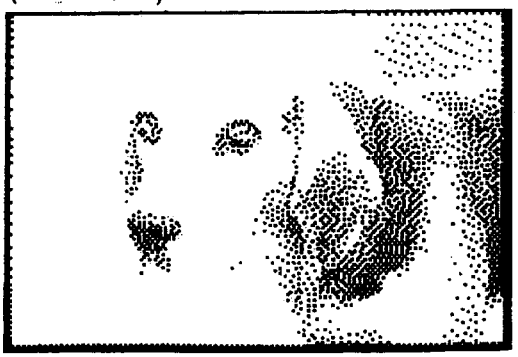
FIG. 10D shows dot pattern of separated black (K)

Subsequently, the reversed color image data is reduced to the number of pixels corresponding to the size of 10 cm×10 cm at a low resolution ranging from 20 to 40 dpi, for example (S13). The aforementioned size of 10 cm×10 cm corresponds to the size of embroidery pattern to be actually sewn (embroidery region). Dot pattern data is produced by calculation employing the error diffusion technique which is one of pseudo-gradation techniques with respect to the reduced color data (S14). In this case, for example, color dot pattern data of 16 to 20 gradations is obtained from the image data by the error diffusion technique (see FIG. 9).

The RGB color dot pattern data is separated by calculation into dot pattern data of four colors of yellow (Y), magenta (M), cyan (C) and black (K), so that dot pattern data (see FIGS. 10A to 10D) of the respective colors (Y, M, C and K) are produced (S15). Subsequently, the dot pattern of each color (Y, M, C and K) is caused to correspond to dots so that needle drop points are calculated (S16). The needle drop points are joined to one another for every color so that sewing data (stitch data) is produced (S17).

Thread tension information to be annexed to sewing data is then produced (S18). Describing the thread tension information, a thread tension table (see FIG. 11) is provided in which drive voltage V of a needle thread tension solenoid of a needle thread tensioner of the sewing machine 1 and dot density (the number of dots) in a predetermined area correspond to each other. The drive voltage ($V_0$ to $V_3$) of the needle thread tension solenoid 32 corresponding to the dot density of 0 to 10 is obtained for every color dot pattern produced at S15. The obtained drive voltage is annexed to the sewing data.

The aforementioned drive voltage is set so that $V_3<V_2<V_1<V_0$. As described above, since the thread tension adjusted by the needle thread tensioner 31 is small when the drive voltage is $V_3$, stitches of the needle thread NT formed in the form of dots on the back Wr of the work cloth W becomes relatively larger. Contrarily, since the thread tension adjusted by the needle thread tensioner 31 is large when the drive voltage V is $V_0$ which is larger, stitches of the needle thread NT formed in the form of dots on the back Wr of the work cloth W becomes relatively smaller.

Subsequently, all the sewing data for the respective colors are synthesized and the synthesized data is reversed horizontally, whereby data for the purpose of display is produced. More specifically, display information reversed so as to become the top surface of the embroidery pattern F2 drawn on the original image G2 is displayed on the display 12 (S19). When the sewing data is transmissible to the sewing machine 1 (YES at S20), sewing data for four colors are transmitted to the sewing machine 1 (S21), and the processing ends.

The embroidery sewing machine 1 executes an embroidery sewing operation based on the sewing data produced as described. The embroidery sewing operation is carried out sequentially for four colors. In this case, regarding sewing data with respect to dot pattern of the yellow (Y), sewing is carried out using a "white" bobbin thread BT and a "yellow" needle thread NT. Regarding sewing data with respect to dot pattern of the magenta (M), sewing is carried out using a "white" bobbin thread BT and a "magenta" needle thread NT. Regarding sewing data with respect to dot pattern of the cyan (C), sewing is carried out using a "white" bobbin thread BT and a "cyan" needle thread NT. Regarding sewing data with respect to dot pattern of the black (K), sewing is carried out using a "white" bobbin thread BT and a "black" needle thread NT.

Figure 12:
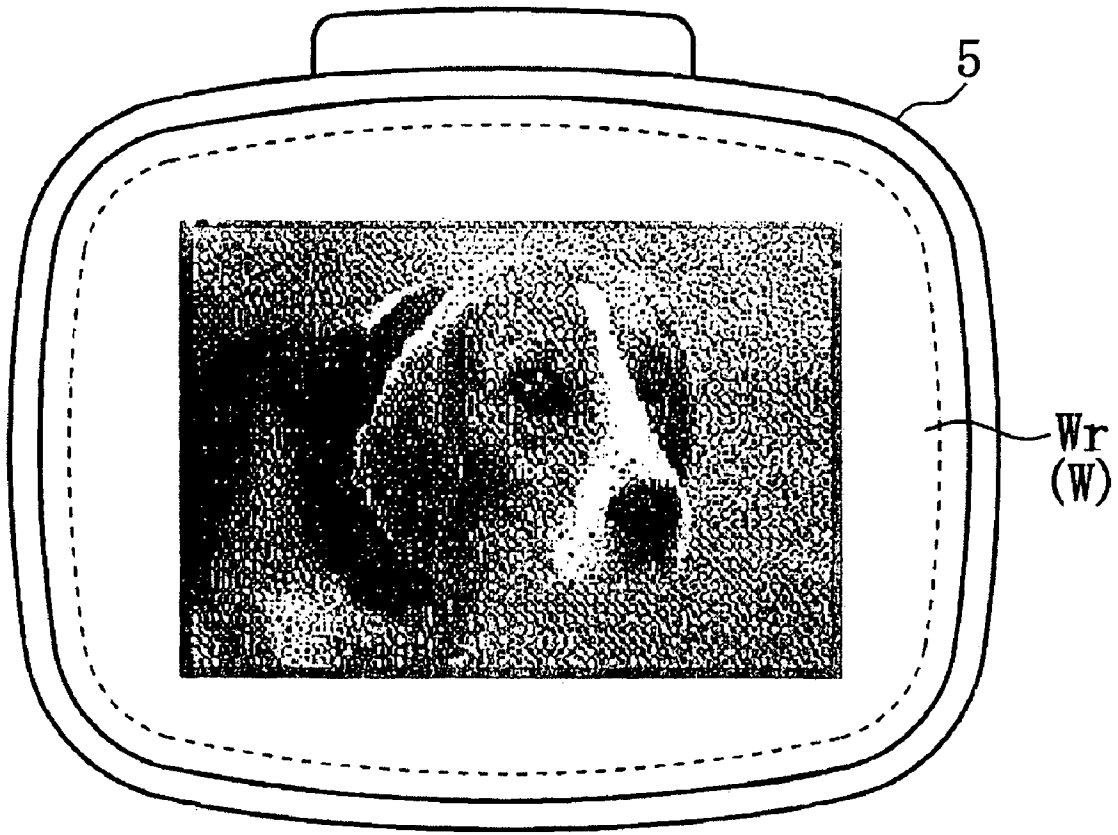
FIG. 12 shows an embroidery pattern of "dog" formed on the back of work cloth.

As a result, the embroidery pattern F2 of the "dog" corresponding to the original image G2 are formed by the dot-like stitches of four colors of needle threads NT, appearing on the back Wr of the work cloth W held on the cloth holding frame 5 as shown in FIG. 12. In this case, the embroidery pattern F2 of the dog can be expressed by dot-like stitches of the needle thread NT which are rich in pictorial expression and sufficiently expressive of such a feeling as produced by a photographic image.

Differing from the conventional arrangement in which an embroidery pattern is sewn by satin stitches of a needle thread NT on a top surface of work cloth W, the embroidery data producing device of the embodiment produces embroidery data which can sew the embroidery pattern using the stitches of the needle thread NT appearing on the back Wr of the work cloth W. Consequently, the sewing data can be produced on which an embroidery pattern can be sewn using stitches which are rich in pictorial expression and sufficiently expressive of such a feeling as produced by a photographic image.

Furthermore, since the error diffusion technique is employed when dot pattern data is produced, the operational processing can be simplified by reducing the number of gradations. Moreover, the sewing data can be produced using the dot pattern suitable for stitch forming at the rough or low resolution. Various types of pseudo-gradation techniques may be employed instead of the error diffusion technique.

Additionally, sewing can be carried out regularly since data of needle drop points corresponding to the respective dots of the dot pattern are calculated and a plurality of needle drop points adjacent to one another in the sewing direction are extracted regularly sequentially on the basis of a dot arrangement of the dot pattern.

Several modified forms of the foregoing embodiment will be described.

At S17 of sewing data production processing in the sewing data producing control, the sewing data may be produced by extracting a plurality of needle drop points adjacent to one another in the sewing direction at intervals of a predetermined number of dots on the basis of data of needle drop points corresponding to the respective dots of the dot pattern. In this case, since the sewing is carried out irregularly at intervals of the predetermined number of dots relative to the dot arrangement of the dot pattern, stitches can easily be formed without being crammed even when the resolution of the dot pattern is high.

Also at S17 of sewing data production processing in the sewing data producing control, in order that the sewing direction may be different from one another for every color, a direction in which the needle drop points are extracted may be different from one another as shown in FIG. 4. For example, regarding the cyan, needle drop points lined up in the X direction may sequentially be joined to one another. Regarding the magenta, needle drop points lined up in the Y direction may sequentially be joined to one another. Regarding the yellow, needle drop points lined up in the XYL directions may sequentially be joined to one another. Regarding the black, needle drop points lined up in the XYR directions may sequentially be joined to one another. In the above-described case, shrinkage of the work cloth W by sewing can be suppressed as compared with a case where all the needle drop points are lined up in the same direction.

When the thread tension information is produced at S18 in the sewing data producing control, for example, dot pattern data of four gradations may be produced for every color in separating color image data read from the image scanner 15 into the four colors of Y, M, C and K, and the drive voltage V of the needle thread tension solenoid 32 may be set according to the gradation of each dot.

In the foregoing embodiment, the sewing data producing device 10 is connected to the embroidery sewing machine 1 so that the sewing data is directly transmitted. However, the sewing data may be stored on an external storage medium so that the sewing data is supplied via the external storage medium to the embroidery sewing machine 1.

The image data obtaining unit should not be limited to one using the image scanner. The image data may be obtained directly from a digital camera or the like or indirectly via a recording medium.

The foregoing description and drawings are merely illustrative of the principles of the disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. An embroidery data producing device for use with an embroidery sewing machine sewing an embroidery pattern on work cloth using a needle thread and a bobbin thread, the embroidery data producing device producing sewing data necessary for an embroidery sewing operation of the embroidery sewing machine, the embroidery data producing device comprising:

an image data obtaining unit that obtains image data of an original image of an embroidery pattern;

a dot pattern data producing unit that produces dot pattern data representative of the embroidery pattern by a dot pattern, based on the image data; and a sewing data producing unit that produces sewing data for obtaining needle drop points forming the embroidery pattern by a pattern of the needle thread appearing in a form of dot on a back of the work cloth by an embroidery sewing operation of the embroidery sewing machine, based on the dot pattern data.

2. The embroidery data producing device according to claim 1, wherein the sewing data producing unit produces the sewing data so that the needle drop point coincides with a position of each dot of the dot pattern, based on the dot pattern data.

3. The embroidery data producing device according to claim 1, wherein the dot pattern data producing unit produces the dot pattern data by a pseudo-gradation technique.

4. The embroidery data producing device according to claim 2, wherein the sewing data producing unit calculates data of a plurality of needle drop points corresponding to each dot of the dot pattern and sequentially connects the needle drop points in a predetermined sewing direction, thereby producing the sewing data.

5. The embroidery data producing device according to claim 2, wherein the sewing data producing unit calculates data of a plurality of needle drop points corresponding to each dots of the dot pattern and extracts the needle drop points in a predetermined sewing direction at intervals of a predetermined number of dots, thereby producing the sewing data.

6. The embroidery data producing device according to claim 1, wherein the image data obtaining unit obtains color image data and the dot pattern data producing unit separates the color image data into a plurality of colors, thereby producing data of dot patterns classified by colors for a plurality of the colors respectively.

7. The embroidery data producing device according to claim 1, wherein the embroidery sewing machine includes a needle thread tensioner and the sewing data producing unit produces thread tension information about thread tension adjustable by the thread tension according to a dot density of the dot pattern data, annexing the thread tension information to the sewing data.

8. The embroidery data producing device according to claim 1, wherein the dot pattern data producing unit produces dot pattern data reversed horizontally relative to the image data.

9. The embroidery data producing device according to claim 6, wherein the sewing data producing unit produces the sewing data so that a sewing direction differs for every dot pattern data by color.

10. An embroidery data producing control program stored on a computer readable medium for use with an embroidery sewing machine sewing embroidery pattern on work cloth using a needle thread and a bobbin thread, the embroidery data producing device producing control program causing a computer to carry out sewing data producing control, the computer controlling a sewing data producing device producing sewing data necessary for an embroidery sewing operation of the embroidery sewing machine, the embroidery data producing control program comprising:

an image data obtaining routine for obtaining image data of an original image of an embroidery pattern;

a dot pattern data producing routine for producing dot pattern data representative of the embroidery pattern by a dot pattern, based on the image data; and a sewing data producing routine for producing sewing data for obtaining needle drop points forming the embroidery pattern by a pattern of the needle thread appearing in a form of dots on a back of the work cloth by an embroidery sewing operation of the embroidery sewing machine, based on the dot pattern data.

11. The embroidery data producing control program according to claim 10, wherein the sewing data producing routine produces the sewing data so that the needle drop point coincides with a position of each dot of the dot pattern, based on the dot pattern data.

12. The embroidery data producing program according to claim 10, wherein the dot pattern data producing routine produces the dot pattern data by a pseudo-gradation technique.

13. The embroidery data producing program according to claim 11, wherein the sewing data producing routine calculates data of a plurality of needle drop points corresponding to each dot of the dot pattern and sequentially connects the needle drop points in a predetermined sewing direction, thereby producing the sewing data.

14. The embroidery data producing program according to claim 11, wherein the sewing data producing routine calculates data of a plurality of needle drop points corresponding to each dot of the dot pattern and extracts the needle drop points in a predetermined sewing direction at intervals of a predetermined number of dots, thereby producing the sewing data.

15. The embroidery data producing program according to claim 10, wherein the image data obtaining routine obtains color image data and the dot pattern data producing routine separates the color image data into a plurality of colors, thereby producing data of dot patterns by colors for a plurality of the colors respectively.

16. The embroidery data producing program according to claim 10, wherein the dot pattern data producing routine produces dot pattern data reversed horizontally relative to the image data.

17. The embroidery data producing program according to claim 15, wherein the sewing data producing routine produces the sewing data so that a sewing direction differs for every dot pattern data by color.

* * * * *